United States Patent [19]

Hernqvist

[11] Patent Number: 4,473,774

[45] Date of Patent: Sep. 25, 1984

[54] CRT WITH INTERNAL NECK COATING FOR SUPPRESSING ARCING THEREIN

[75] Inventor: Karl G. Hernqvist, Princeton, N.J.

[73] Assignee: RCA Corporation, New York, N.Y.

[21] Appl. No.: 347,108

[22] Filed: Feb. 9, 1982

[51] Int. Cl.[3] ..... H01J 29/88; B05D 5/12

[52] U.S. Cl. ..... 313/479; 427/64

[58] Field of Search ..... 313/479; 427/64

[56] References Cited

U.S. PATENT DOCUMENTS

| | | | |
|---|---|---|---|
| 3,355,617 | 11/1967 | Schwartz et al. | 313/82 |
| 3,758,802 | 9/1973 | Kubo et al. | 313/64 |
| 3,771,003 | 11/1973 | Kerr et al. | 29/50 |
| 3,979,632 | 9/1976 | Gunning et al. | 313/479 |
| 4,249,107 | 2/1981 | Kilichowski | 313/479 |

OTHER PUBLICATIONS

*RCA Technical Notes* TN No. 1290, Jan. 21, 1982, "CRT With External Anti-Corona Coating" by Deal and Bartch.

*Primary Examiner*—Palmer Demeo
*Assistant Examiner*—Sandra L. O'Shea
*Attorney, Agent, or Firm*—E. M. Whitacre; D. H. Irlbeck; L. Greenspan

[57] ABSTRACT

CRT (cathode-ray tube) comprises an evacuated glass envelope, an electron-gun mount assembly housed in the envelope, the electrodes of said envelope being confined by closely-spaced glass surfaces, and an insulative coating on said glass surfaces opposite electrodes of said mount assembly. The insulative coating is a substantially-continuous, noncrystalline film of a nonionic organic polymeric material.

5 Claims, 3 Drawing Figures

CRT WITH INTERNAL NECK COATING FOR SUPPRESSING ARCING THEREIN

BACKGROUND OF THE INVENTION

This invention relates to a CRT (cathode-ray tube) having a novel internal coating for suppressing arcing therein during the operation thereof; and particularly for suppressing flashovers in a CRT having a glass neck with an electron-gun mount assembly housed therein.

A color television picture tube is a CRT which comprises an evacuated envelope including a viewing window that carries a luminescent viewing screen, and a glass neck that houses an electron-gun mount assembly. During operation of the tube, the mount assembly produces one or more electron beams for selectively scanning the viewing screen so as to produce a viewable video image thereon.

During the operation of the tube, an excessive amount of stray or uncontrolled electron emission and electrical leakage sometimes develops within and/or around the structure of the mount assembly. This condition may result in flashovers, a form of arcing, which may degrade the performance of the tube and/or may be destructive of the tube and/or associated circuitry. Excessive stray or uncontrolled electron emission, leakage and arcing are a result of a combination of factors involving the electrodes and the closely-spaced glass surfaces of the neck. Various structures on the internal surfaces of the neck or on the mount assembly for suppressing such arcing have been suggested.

U.S. Pat. No. 3,355,617 to J. W. Schwartz et al. discloses an internal, electrically-resistive coating of iron oxide on the neck. U.S. Pat. No. 3,758,802 to T. Kubo et al. discloses an internal coating of crystallized glass on the neck. U.S. Pat. No. 3,979,632 to E. A. Gunning et al. discloses an internal coating of insulative chromic and/or ferric oxide on the neck. U.S. Pat. No. 4,285,990 to K. G. Hernqvist discloses an internal coating of chromium metal on the neck. Each of these prior coatings is located on the inside surface of the glass neck opposite the electrodes which produce focusing fields for the electron beam. While each of these coatings may have had a beneficial effect in some tube designs, the beneficial effect has not been great enough to find much commercial use. All of these coatings are of inorganic materials which, it is believed, permit alkali ions in the underlying neck glass to move to the internal surface thereof, producing an electronically-active surface from which "blue glow" and arcing can be supported when the tube is operated. Also, when the tube is electrically processed by spot knocking, undesirable particles of the coating are usually released into the tube and interfere with its proper performance.

SUMMARY OF THE INVENTION

The novel tube is similar in structure to prior tubes except that there is a coating of nonionic, organic polymeric material on the internal glass surfaces opposite electrodes of the mount assembly. The coating is a continuous film, preferably of a polyimide, in the form of a circumferential band that preferably covers all of the glass surface from the internal funnel coating to beyond the electrodes of the mount assembly. Tubes so coated did not exhibit "blue glow" and had a significant reduction in arcing and particle-related problems on average.

DETAILED DESCRIPTION OF THE PREFERRED EMBODIMENT

Figure 1:
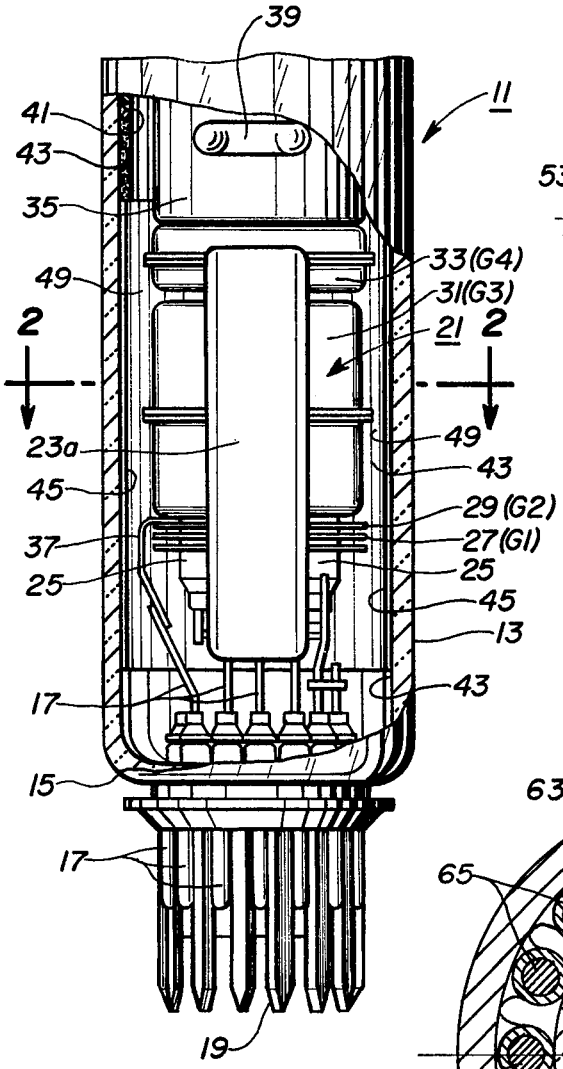
FIG. 1 is a broken-away, front, elevational view of the neck of a CRT having a novel internal neck coating according to the invention.
Figure 2:
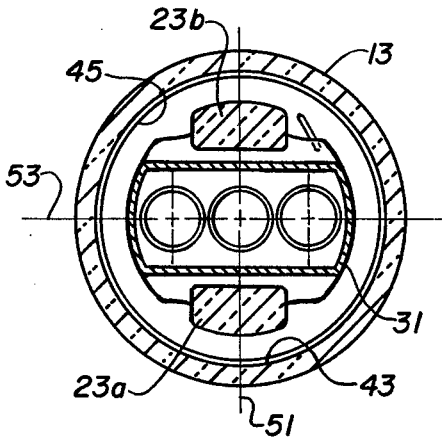
FIG. 2 is a sectional view along section line 2—2 through the neck of the CRT shown in FIG. 1.

FIGS. 1 and 2 show structural details of the neck of a particular shadow-mask-type color television picture tube. The structure of this CRT, which is a rectangular 19 V size tube with 90° deflection, is conventional except for the internal neck coating. The CRT includes an evacuated glass envelope 11 comprising a rectangular faceplate panel (not shown) sealed to a funnel having a glass neck 13 integrally attached thereto. A glass stem 15 having a plurality of leads or pins 17 therethrough is sealed to and closes the neck 13 at the end thereof. A base 19 is attached to the pins 17 outside the envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly 21 comprises first and second glass support rods or beads **23*a* and 23*b* respectively from which the various electrodes are supported to form a coherent unit in a manner commonly used in the art. These electrodes include three substantially equally transversely spaced coplanar cathodes (one for producing each beam) housed in three cathode sleeves 25, a control-grid electrode (also referred to as G1) 27, a screen grid electrode (also referred to as G2) 29, a first accelerating-and-focusing electrode (also referred to as G3) 31, a second accelerating-and-focusing electrode (also referred to as G4) 33, and a shield cup 35, longitudinally spaced in that order by the beads 23*a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with an electrically-conductive internal coating 41 on the inside surface 43 of the neck 13. The conductive coating 41 extends over the inside surface of the funnel and connects to the anode button (not shown) and into the neck 13**.

An organic insulative coating 45 resides on the entire internal surface of the neck 13 from the conductive coating 41 to below the bottom of the cathode sleeves 25, which is about 25 mm above the stem 15. The insulative coating 45 is a polyimide about 0.025 millimeter (1.0 mil) thick which has a resistivity of more than $10^{10}$ ohms per square. The insulative coating 45 was polymerized in situ by the following method, which is preferred. A quantity of liquid Pyralin 2550, marketed by E. I. duPont de Nemours, Wilmington, Del., was brushed on the area of interest before the mount assembly 21 was sealed into the neck 13. The coated neck 13 was then baked in air for about 30 minutes at about 185° and then baked in air for about 60 minutes at about 300° to produce the insulative coating 45. Then, the mount assembly 21 was sealed into the neck 13, and the assembly of the CRT was completed by the usual processing steps.

FIG. 2 also shows the minor and major transverse axes 51 and 53 respectively, whose positions are vertical and horizontal respectively, when the screen of the tube is normally viewed. Although the insulative coating 45 is shown butting against the conductive coating 41, it is preferred that the insulative coating 45 slightly overlaps the conductive coating 41 to assure that there is no uncovered glass surface. When tubes constructed in this way were operated in their normal manner with about 30 kilovolts applied to G4, they did not exhibit blue glow or flashovers as is common with similar tubes without the cured coating 45. Voltage measurements on the tube showed no significant charging (less than 10 kilovolts) of the neck glass opposite G3 and G4.

GENERAL CONSIDERATIONS

The invention may be applied generally to cathode-ray tubes comprising an evacuated glass envelope, and an electron-gun mount assembly housed in said envelope, wherein the electrodes of the mount assembly are confined by closely-spaced glass surfaces. In such structures, arcing occurs in and around electrodes of the mount assembly. An insulative coating according to the invention completely covering the glass surfaces in the active areas will suppress such arcing.

The insulative coating 45 of the CRT shown in FIGS. 1 and 2 has the effect of suppressing blue glow and flashovers and also suppressing the generation of insulative particles which originate from the neck glass. The insulative coating must be in the form of a substantially-continuous, noncrystalline film of a nonionic organic polymeric material. It is preferably about 0.0025 to 0.038 millimeter (0.1 to 1.5 mil) thick, although a much greater or much less lesser thickness may be used. It is not understood why such a film should suppress blue glow and arcing. Measurements have shown that the presence of the insulative coating reduces the buildup of charge on the inside of the glass neck during the operation of the tube. Again, this has not been explained, and no theory for the phenomenon is available. It is believed that the insulative coating should have a sheet resistivity of at least $10^{10}$ ohms per square.

While there are many organic polymeric materials which can form substantially-continuous noncrystalline films, there are few such polymeric materials that are suitable as internal coatings for cathode-ray tubes, since most such materials are degraded, or destroyed or volatilized by the conditions present during the subsequent processing of the tube. After the viewing screen has been fabricated on the inside of the faceplate panel, the panel is sealed to the funnel. This panel-sealing step subjects the tube to temperatures of about 400° to 450° for about 0.5 to 1.0 hour in air. After panel sealing, the stem is sealed into the mount, during which step the neck glass adjacent the stem is molten. After stem sealing, the entire tube is baked and exhausted of gases at temperatures of about 300° to 400° C. for about 1.0 to 2.0 hours.

In view of these processing conditions, the cured insulative coating must stand at least 300° C., and preferably up to 450° C., for about 0.5 to 1.5 hour without substantial deterioration. Materials in several polymeric classes can satisfy these conditions; for example, polyimides, polybenzimidazoles, poly(phenyl) quinoxalines, polyamides, polycarboranes and polyphosphazenes. These and others are described in "Polymers for Extreme Service Conditions" *J. Chem. Ed.* 58, 951–955 (1981) and "History of Heat-Resistant Polymers" *J. Macromol. Sci.-Chem. A*15, 1435–1450 (1981), both articles by Patrick E. Cassidy.

At present, polyimides are preferred because they are most easily available and at lowest cost. Some suitable polyimides are made from precursor solutions such as Pyralin PI-2550, PI-2555, PI-2540, PI-2545 and PI-2560, all marketed by E. I. duPont, Wilmington, Del. Technical bulletins on these materials state that they are covered by U.S. Pat. No. 3,179,614 to W. M. Edwards. These precursor materials are viscous liquids which are brushed or sprayed on the surface of interest to the desired thickness and then cured in situ to produce the polyimide. Curing involves heating in air, first at about 120° to 160° C. for about 0.4 to 0.8 hour, and then at about 280° to 450° C. for about 0.2 to 1.2 hours. The cured coating has a surface resistivity of about $10^{15}$ ohms and a dielectric strength of about 4,000 volts per mil. The glass surface may be precoated with an adhesion promotor to prevent peeling and flaking of the cured coating. Also, curing should be conducted soon after depositing the layer of precursor in order to avoid peeling problems.

The geometric extent of the insulative coating has been the subject of study. It was found that leaving a gap between the conductive and insulative coatings leads to blue glow in the uncovered area of the neck glass during the normal operation of the tube and/or arc erosion at the edge of the insulative coating during the electrical processing of the tube. Therefore, it is recommended that there be no gap between the insulative and conductive coatings and, preferably, that the coatings overlap. With the coatings touching or overlapping, the insulative coating should extend toward the stem at least to a position opposite the gap between G3 and G4 of the mount assembly. Shorter insulative coatings produce tubes which may exhibit blue glow during normal operation. Preferably, the insulative coating covers all of the neck surface opposite the electrodes of the mount assembly.

The steps of curing the insulative coating may be conducted as a separate procedure from the usual manufacturing steps of the tube. These steps may be conducted before panel sealing, before stem sealing, or before baking-and-exhausting the tube, provided the subsequent processing steps do not degrade the characteristics of the insulative coating. Alternatively, the curing can be conducted during one of the usual steps for manufacturing the CRT, if the step is suitably controlled.

Figure 3:
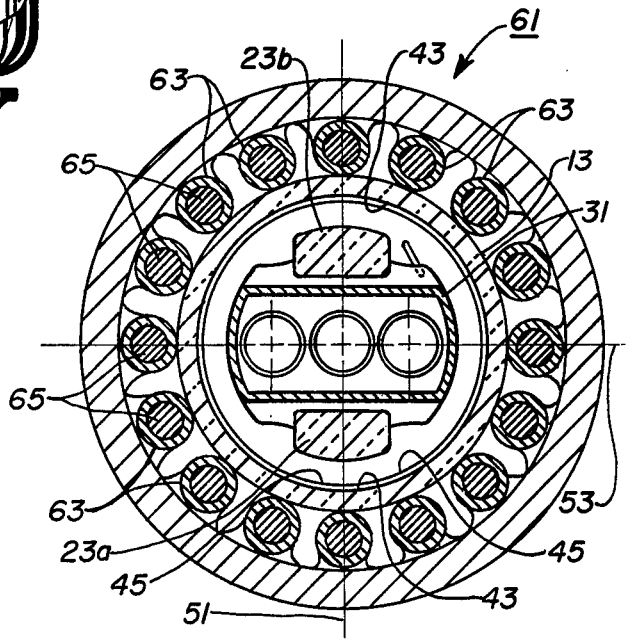
FIG. 3 is a sectional view of the neck of a CRT illustrating the use of a heat sink during tube processing subsequent to preparing the internal neck coating.

The cured or partly-cured insulative coating can be protected from overheating in any of the processing steps with the use of a clamp-on heat sink around the neck, such as the heat-sink device 61 shown in FIG. 3. The device 61 comprises a thermally-insulating cylindrical shell 63 having a plurality of stainless-steel tubular containers 63 attached to the inner surface of the shell 63. Each cylinder 63 is filled with metallic tin 65 or other low-melting metal or metal alloy and sealed. The device 61 is slipped over the neck 13 of the CRT (which is similar to the CRT shown in FIG. 2), where it resides during a processing step involving a heat treatment and then may be slipped off. During the processing step, the cylinders 63 press against the neck 13 and are heat insulated from the outside. During the processing step, the heat energy required to heat the cylinders 63 and to melt the tin 65 is high enough to keep the temperature of the neck 13 low enough for the time required to prevent degradation of the insulative coating.

Tubes prepared with an insulative internal neck coating are electrically processed by spot knocking. However, the more vigorous treatment known as RFSK (radio frequency spot knocking) such as is described in U.S. Pat. No. 4,214,798 to L. F. Hopen, for example, cannot be used. During such vigorous treatment, electric fields concentrate at the boundary between the insulative and conductive coatings and frequently cause a puncture of the neck glass. This has several advantages, however. RFSK is believed to rupture bubbles present in the glass neck, providing a source of particles which migrate through the tube and may degrade its operation. The insulative coating obviates the need for RFSK and, furthermore, traps any glass particles under the coating. So, tubes having apertured masks and the insulative neck coating therein exhibit fewer blocked apertures on average.

In operating tubes prepared with an insulative internal neck coating, the high voltage applied to G4 does not transmit along the neck glass towards the stem. As a consequence, no blue glow and/or flashovers are observed. Some advantages of this are that fewer particles are transported by the action of electrical fields inside the tube, and that other expedients for suppressing blue glow and flashovers are unnecessary.

What is claimed is:

1. In a cathode-ray tube comprising an evacuated glass envelope, an electron-gun mount assembly housed in said envelope, electrodes of said mount assembly being confined by closely-spaced internal glass surfaces, and an insulative coating on said internal glass surfaces opposite electrodes of said mount assembly, the improvement wherein said coating is a substantially-continuous, noncrystalline film of a nonionic organic polymeric material consisting essentially of a polyimide.

2. The tube defined in claim 1 wherein said material is physically and chemically stable at temperatures up to at least 300° C. for at least 0.5 hour.

3. The tube defined in claim 1 wherein said coating material is polymerized in situ.

4. The tube defined in claim 1 wherein said material is a polyimide having a resistivity greater than $10^{10}$ ohms per square.

5. The tube defined in claim 1 wherein said envelope includes a glass neck, said tube includes an internal electrically-conductive coating on said envelope, a portion of which extends into said neck, and said insulative coating covers all of said inner neck surface opposite electrodes of said mount assembly, up to and into contact with said conductive coating.

* * * * *